US007520797B2

(12) United States Patent
Bottema et al.

(10) Patent No.: US 7,520,797 B2
(45) Date of Patent: Apr. 21, 2009

(54) PLATEN ENDPOINT WINDOW WITH PRESSURE RELIEF

(75) Inventors: Brian E. Bottema, Austin, TX (US); Stephen F. Abraham, Austin, TX (US); Alex P. Pamatat, Austin, TX (US)

(73) Assignee: Freescale Semiconductor, Inc., Austin, TX (US)

( * ) Notice: Subject to any disclaimer, the term of this patent is extended or adjusted under 35 U.S.C. 154(b) by 399 days.

(21) Appl. No.: 11/221,376

(22) Filed: Sep. 6, 2005

(65) Prior Publication Data

US 2007/0054602 A1 Mar. 8, 2007

(51) Int. Cl.
*B24B 1/00* (2006.01)
*B24B 29/00* (2006.01)
*B29C 65/00* (2006.01)

(52) U.S. Cl. ..... 451/59; 451/36; 451/41; 451/288; 156/87

(58) Field of Classification Search ..... 451/5, 451/8, 36, 41, 59, 285–290, 6; 156/345.12, 156/345.13, 345.15, 345.16
See application file for complete search history.

(56) References Cited

U.S. PATENT DOCUMENTS 5,334,482 A 8/1994 Aono
6,599,765 B1 * 7/2003 Boyd et al. ..... 438/16
6,709,493 B2 3/2004 DeGuiseppi et al.
6,875,077 B2 4/2005 Petroski et al.
6,887,138 B2 5/2005 Bottema et al. ..... 451/72
6,905,392 B2 6/2005 Bottema et al. ..... 451/5
7,179,151 B1 * 2/2007 Bottema et al. ..... 451/6
7,210,980 B2 * 5/2007 Swedek et al. ..... 451/6
7,226,339 B2 * 6/2007 Benvegnu et al. ..... 451/6
2002/0137435 A1 9/2002 Hu et al.
2003/0181135 A1 * 9/2003 Liu ..... 451/6
2003/0205325 A1 11/2003 Boyd et al.
2004/0053566 A1 3/2004 Tolles et al.

OTHER PUBLICATIONS

International Search Report dated Jul. 30, 2007.

* cited by examiner

*Primary Examiner*—Timothy V Eley
(74) *Attorney, Agent, or Firm*—Hamilton & Terrile, LLP; Michael Rocco Cannatti

(57) ABSTRACT

A polish pad (40, 42) and platen (50) assembly for use in chemical mechanical polishing of semiconductor devices includes a platen (50) having a vented endpoint window (62, 72, 82) with one or more venting passageways (e.g., 64, 66) and/or a grooved or channeled platen surface (176) to prevent air pressure buildup in the air gap (46) by discharging or venting air through one or more vent pathways (52) formed in the platen to provide a pathway to ambient or sub-ambient environment. The air permeable construction of the vented endpoint window (72) provides pressure relief for the air gap (46) between the pad endpoint window (44) and the vented endpoint window (72), but may also include passages (75, 76) that are filled with an air permeable hydrophobic material which protects the underlying endpoint detection system (30, 32) from contamination during cleaning of the platen endpoint window (72).

20 Claims, 3 Drawing Sheets

PLATEN ENDPOINT WINDOW WITH PRESSURE RELIEF

BACKGROUND OF THE INVENTION

1. Field of the Invention

The present invention is directed in general to the field of semiconductor manufacturing. In one aspect, the present invention relates to the equipment for use in chemical mechanical polishing (CMP) in the manufacture of integrated circuits.

2. Description of the Related Art

In the manufacture of integrated circuits on semiconductor wafers, various layers are formed over one another, resulting in irregular or non-planar surface topologies. At any given stage in the fabrication of an integrated circuit, the non-planar surfaces can adversely affect subsequent processing steps, can lead to device failure and can reduce yield rates. For example, when metal lines are formed over a semiconductor structure, any non-planar surfaces can impede the ability to remove metal from the structure where it does not belong.

A common process for smoothing surface irregularities is through chemical mechanical planarization or chemical mechanical polishing (CMP). This process typically involves pressing a semiconductor wafer against a polishing pad at a controlled pressure, where either or both of the wafer and pad are rotating with respect to one another. With CMP equipment, the polishing pad typically includes a pressure sensitive adhesive layer which is used to affix the pad to a supporting platen structure. By spinning the polishing pad while the semiconductor wafer is pressed against the polishing pad in the presence of a chemically active or abrasive material or liquid media (slurry), the upper surface of the semiconductor wafer is planarized. The extent of polishing may be measured with laser interferometry or light reflectance techniques which use in-situ monitoring sensors located in the polishing pad or supporting platen assembly.

To allow light from the polishing environment at the wafer surface to be reflected back and measured, aperture windows in the polishing pad (referred to as the pad endpoint window) and in the platen assembly (referred to as the platen endpoint window) are aligned to allow light to pass from a laser or light source in the platen, to the wafer surface being polished and back to a sensor in the platen. However, during polish operations, air pressure builds up in the cavity that exists between the pad endpoint window and the platen endpoint window, which can cause bulging of the polishing pad endpoint window. Such bulges in the pad endpoint window create non-uniformities on the polished surface, and can cause the pad to breakthrough or slip/break wafers during the polishing process. In addition, any deformation of the pad endpoint window can introduce error to the endpoint signal that is used to stop polish operations, which in turn can cause wafers to be scrapped. Moreover, any bulging of the pad endpoint window can create excessive and/or localized wear of the pad endpoint window material. While prior attempts have been made to improve endpoint detection accuracy by providing a stable slurry or fluid environment at the wafer surface polish region, such solutions failed to prevent the fluid from entering between a platen window and pad window, which can adversely affect adhesion between the pad and platen, and can impair endpoint signal reliability.

Accordingly, a need exists for an improved CMP equipment assembly that eliminates the entrapment of air between the platen endpoint window and the polishing pad endpoint window. In addition, there is a need to prevent infiltration of polishing fluids from entering between the polishing pad and platen. There is also a need for an improved apparatus and device to overcome the problems in the art, such as outlined above. Further limitations and disadvantages of conventional processes and technologies will become apparent to one of skill in the art after reviewing the remainder of the present application with reference to the drawings and detailed description which follow.

BRIEF DESCRIPTION OF THE DRAWINGS

The present invention may be understood, and its numerous objects, features and advantages obtained, when the following detailed description is considered in conjunction with the following drawings, in which.

Figure 1:
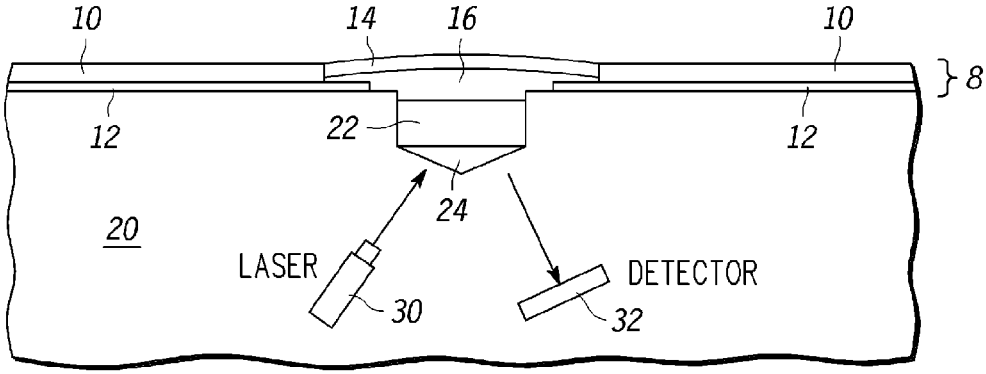
FIG. 1 (PRIOR ART)
FIG. 1 illustrates a side view of a polishing pad and platen assembly in which pressure buildup causes the pad endpoint window region to bulge.

It will be appreciated that for simplicity and clarity of illustration, elements illustrated in the drawings have not necessarily been drawn to scale. For example, the dimensions of some of the elements are exaggerated relative to other elements for purposes of promoting and improving clarity and understanding. Further, where considered appropriate, reference numerals have been repeated among the drawings to represent corresponding or analogous elements.

DETAILED DESCRIPTION

A polish pad and platen assembly is described which vents the space between a pad endpoint window and a platen endpoint window to prevent or reduce the buildup of air pressure between the platen endpoint window and the pad endpoint window and to prevent liquids, vapors or other undesirable contaminants from the polishing process from infiltrating the area between the pad and platen. The disclosed polish pad and platen assembly may be used to improve the reliability of endpoint detection measurements used in manufacturing a semiconductor wafer at any stage of manufacture, including but not limited to inter-layer dielectric (ILD), shallow trench isolation (STI), tungsten and copper layer polish processes. With increased endpoint detection accuracy, false/early endpoint detection and wafer slips are reduced or eliminated, thereby reducing tool downtime, improving SPC metrics, reducing wafer scrap, preventing damage to polisher and reducing cost of ownership. The disclosed polish pad and platen assembly also prevents infiltration of polishing by-products between the pad and platen, thereby maintaining the pad/platen adhesion and protecting the endpoint signal detection component circuitry from contamination. Various illustrative embodiments of the present invention will now be described in detail with reference to the accompanying figures. While various details are set forth in the following description, it will be appreciated that the present invention may be practiced without these specific details, and that numerous implementation-specific decisions may be made to the invention described herein to achieve the device designer's specific goals, such as compliance with process technology or design-related constraints, which will vary from one implementation to another. While such a development effort might be complex and time-consuming, it would nevertheless be a routine undertaking for those of ordinary skill in the art having the benefit of this disclosure. For example, selected aspects are depicted with reference to simplified drawings in order to avoid limiting or obscuring the present invention. Such descriptions and representations are used by those skilled in the art to describe and convey the substance of their work to others skilled in the art. Various illustrative embodiments of the present invention will now be described in detail with reference to FIGS. 1-9. It is noted that, throughout this detailed description, certain elements in the figures are illustrated for simplicity and clarity and have not necessarily been drawn to scale. For example, the dimensions of some of the elements in the figures may be exaggerated relative to other elements to help improve the understanding of the embodiments of the present invention.

FIG. 1 illustrates a side view of a polishing pad platen assembly wherein one or more polishing pads 8 are affixed to a supporting platen structure 20. As will be appreciated, the polishing pad 8 can include any suitable pad structure for a particular polishing operation, and may be formed from one or more foamed or porous materials that are flexible or semi-rigid, depending on the type and thickness of material used. An example of a CMP polishing pad that can be used is the IC 1000 polish pad, though other pads may also be used. An example of a multi-layer pad is shown in FIG. 1, where the polishing pad includes a top layer 10 that is affixed to a bottom layer 12 having an aperture 16 formed therein. A pressure sensitive adhesive (not shown) may be used to affix the top layer 10 to the bottom layer 12. Where multiple pad layers are provided, each pad layer (e.g., 12) includes an aperture which is formed in alignment with the other pad window apertures. However, it will be appreciated that the polishing pad need not include any endpoint window, but can instead be formed with a clear pad material or semi-transparent pad material. In addition, there are other endpoint detection techniques that do not require a pad endpoint window when endpoint detection occurs through the polishing pad.

The polishing pad 8 is affixed to the supporting platen 20 via a pressure sensitive adhesive layer (not shown), which in turn is affixed to an underlying polishing equipment assembly (not shown) so that the entire polishing pad and platen assembly may be placed in polishing contact with the structure being polished. One example of polishing contact is rotating the polishing pad and platen assembly about a central axis as the rotating assembly is applied to the polish structure. Of course, other motion patterns may be used to provide polishing contact, including moving the polishing pad and platen assembly in an orbital motion, in a linear motion or in any predetermined pattern. Another example of polishing contact is to maintain the polishing pad and platen assembly in a stationary position and to move the polish structure in relation to the stationary assembly. The platen 20 provides a rigid structural support for the polishing pad 8, and also includes an in-situ endpoint detection system, such as a laser light source 30 (or other optical source) and detector 32, that is used to provide in-situ monitoring of CMP operations. By using a light source 30 to generate a beam of laser or broad-spectrum light that is directed towards a semiconductor substrate undergoing CMP processing, the reflected light from the wafer can be detected at the detector 32 to monitor the status of the wafer polishing process.

To protect the endpoint monitoring process, one or more endpoint windows are included in the polishing pad 8 and/or the platen 20. In a selected embodiment, the polishing pad 8 includes a window aperture in which is formed a transparent or semi-opaque pad endpoint window 14 that is formed from the same material as the remainder of the pad 10 or that is formed from a different material. In alternative embodiments, the polishing pad does not include a pad endpoint window, but is instead formed of a material through which laser light is able to pass. As for the platen 20, a window aperture 24 is included in which is formed a transparent or semi-opaque platen endpoint window 22 (also referred to as a diffuser window). However formed, the endpoint windows allow a laser beam or other light source 30 to access the surface of semiconductor wafer structure being polished and to reflect back to the sensor 32. While the use of two endpoint windows provides improved protection of the endpoint detection system, pressure in the air gap 16 between the endpoint windows 14, 22 can expand during polishing operations and cause the pad endpoint window 14 to bulge, as depicted in FIG. 1. When the pad endpoint window 14 bulges from pressure buildup, it cannot be repaired, the pad must be replaced.

Figure 2:
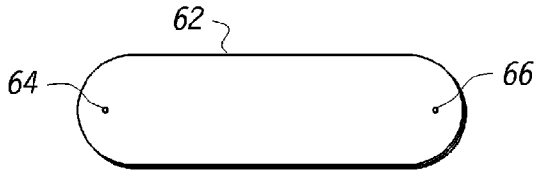
FIG. 2 illustrates a top view of a platen endpoint window of FIG. 3.

A selected embodiment of the present invention uses one or more passageways in the platen endpoint window to alleviate the pressure buildup between the pad and platen endpoint windows by venting to an ambient environment that is separate of the polishing environment. A top view of an illustrative example of such a vented platen endpoint window 62 is depicted in FIG. 2. As illustrated, the platen endpoint window 62 includes one or more passageways 64, 66. These passageways may be formed by molding, cutting, burning or machining the window 62 with small holes that allow air to flow to an ambient environment. In a first illustrative embodiment, two passageways 64, 66 are formed, each having a diameter of approximately 0.02 inches (e.g., 0.02±0.003 inches), though other physical dimensions (e.g., size and spacing) may be used depending on various design considerations, such as the thickness of the diffuser window or the size of the air gap 46.

Figure 3:
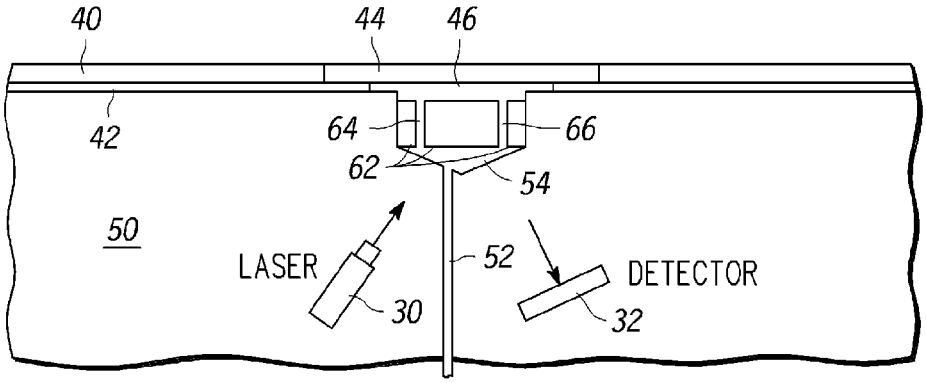
FIG. 3 illustrates a side view of a platen endpoint window installed in a polishing pad and platen assembly in accordance with a first illustrative embodiment of the present invention.

To illustrate how the platen endpoint window 62 may be used to alleviate pressure buildup in the air gap 46 which can cause the pad endpoint window region 44 to bulge, FIG. 3 shows a side view of the platen endpoint window 62 installed in a polishing pad and platen assembly in accordance with a first illustrative embodiment of the present invention. As illustrated, the platen 50 is formed with a window aperture 54 in which is formed a platen endpoint window 66 having one or more venting passageways 64, 66. The platen endpoint window 62 is protected and sealed from the processing environment by the pad endpoint window 44 in the pad 40, 42 which prevents polishing materials (such as abrasive materials, fluid and/or liquid vapor) or other undesirable contaminants from the CMP process from intruding into the area 46 between the pad 40, 42 and platen 50. However, the passageways 64, 66 in the platen endpoint window 62 allow any buildup in air pressure in the air gap 46 to discharge or vent through the vent pathway(s) 52. In the depicted embodiment, the vent pathway 52 is formed as a hole that is drilled through the platen 50 and into the bottom of the window aperture 54. As will be appreciated, the vent pathway 52 may be connected through the platen 50 to an access hole in the lower control area of the polishing equipment (such as a 200 Mirra polisher) for venting to an ambient or sub-ambient environment. By providing a pathway 52 to an ambient or sub-ambient environment, any air pressure in the air gap 46 between the pad endpoint window 44 and the platen endpoint window 62 are readily removed or vented. However, the pathway 52 may be used to vent air pressure or pockets without requiring the use of vacuum equipment, thereby reducing the cost and complexity of the overall CMP assembly.

Figure 4:
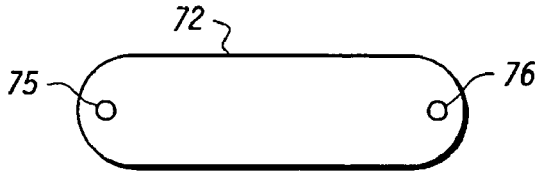
FIG. 4 illustrates a top view of a platen endpoint window of FIG. 5.
Figure 5:
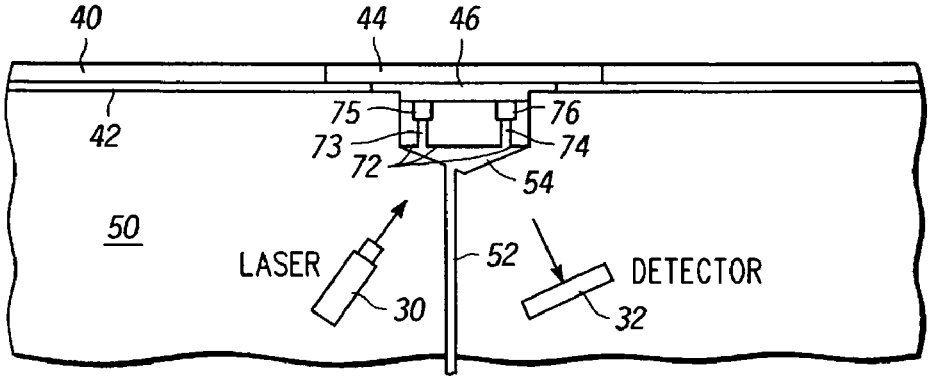
FIG. 5 illustrates a side view of a platen endpoint window installed in a polishing pad and platen assembly in accordance with a second illustrative embodiment of the present invention.

As will be appreciated, other pressure relief techniques may be used in addition to or in place of the vented platen endpoint window 62 for relieving pressure in the air gap between the pad and platen endpoint windows. For example, FIG. 4 illustrates a top view of a platen endpoint window 72 in accordance with a second illustrative embodiment of the present invention. The endpoint window 72 includes one or more machined passages 75, 76 that are filled with an air permeable hydrophobic material that prevents liquid from flowing through the window 72 and allows air flow through the window 72 to an ambient environment. The hydrophobic nature of the passageway filling is particularly useful for protecting the underlying endpoint detection system from contamination during cleaning of the platen endpoint window 72. This is illustrated in FIG. 5, which shows a side view of a platen endpoint window 72 installed in a polishing pad and platen assembly to alleviate the pressure buildup in the air gap 46 between the pad and platen endpoint windows. As illustrated, the pad endpoint window 44 in the pad 40, 42 protects and seals the platen endpoint window 72 from the processing environment by preventing liquid vapor or other undesirable contaminants from the CMP process from intruding into the area 46 between the pad 40, 42 and platen 50. Any pressure that builds up in the air gap 46 during polish operations is vented or discharged by the platen endpoint window 72 through one or more venting passageways 73, 74. These passageways 73, 74 may be formed by molding, cutting, burning or machining the window 72 with small holes that allow air to flow to an ambient environment. By filling at least part of the passageways 73, 74 with a hydrophobic material 75, 76, any liquid vapor or other undesirable fluid (such as cleaning chemicals used to clean the installed platen endpoint window 72) would be unable to penetrate into the area 46 between the pad 40, 42 and platen 50, thereby protecting the endpoint detection system (e.g., laser and detector) in the subplaten cavity (not shown) from contamination. However, the air permeable nature of the passageways 73-76 will allow air pressure buildup in the air gap 46 to discharge or vent through the vent pathway(s) 52 in the platen 50 that are connected to an access hole in the lower control area of the polishing equipment (not shown) for venting to an ambient or sub-ambient environment.

Figure 6:
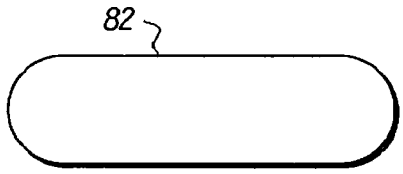
FIG. 6 illustrates a top view of a platen endpoint window of FIG. 7.
Figure 7:
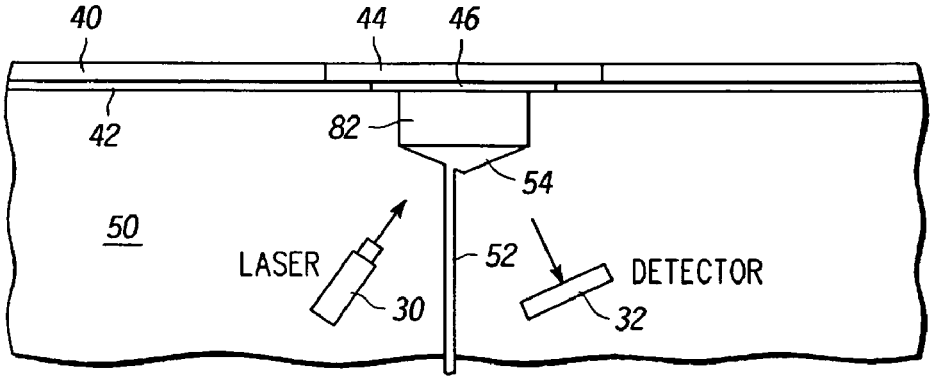
FIG. 7 illustrates a side view of a platen endpoint window installed in a polishing pad and platen assembly in accordance with a third illustrative embodiment of the present invention.

Yet another technique for venting air gap pressure is to form the entire platen endpoint window with a material that is air permeable, or with an air permeable hydrophobic material, thereby eliminating the need to form individual passageways in the window. An example is depicted in FIG. 6, which illustrates a top view of a platen endpoint window 82 in accordance with a third illustrative embodiment of the present invention. Instead of using machined passageways, the entirety of the endpoint window 82 is constructed from an air permeable material that will allow the passage of air, but not liquid, to the ambient environment. This is illustrated in FIG. 7, which shows a side view of a platen endpoint window 82 installed in a polishing pad and platen assembly to alleviate the pressure buildup in the air gap 46 between the pad and platen endpoint windows. As illustrated, the pad endpoint window 44 in the pad 40, 42 protects and seals the platen endpoint window 82 from the processing environment by preventing liquid vapor or other undesirable contaminants from the CMP process from intruding into the area 46 between the pad 40, 42 and platen 50. The air permeable nature of the platen endpoint window 82 will allow air pressure buildup in the air gap 46 to discharge or vent through the vent pathway(s) 52 in the platen 50 that are connected to an access hole in the lower control area of the polishing equipment (not shown) for venting to an ambient or sub-ambient environment. While the material used to form the platen endpoint window 82 may optionally have sufficient hydrophobic properties to protect the underlying endpoint detection system from contamination during cleaning of the platen endpoint window 82, the material should also be sufficiently transparent to allow the endpoint signal to be usable. For example, the paten endpoint window 82 should allow a laser beam or other light source 30 to access the surface of semiconductor wafer structure being polished and to reflect back to the sensor 32.

Figure 8:
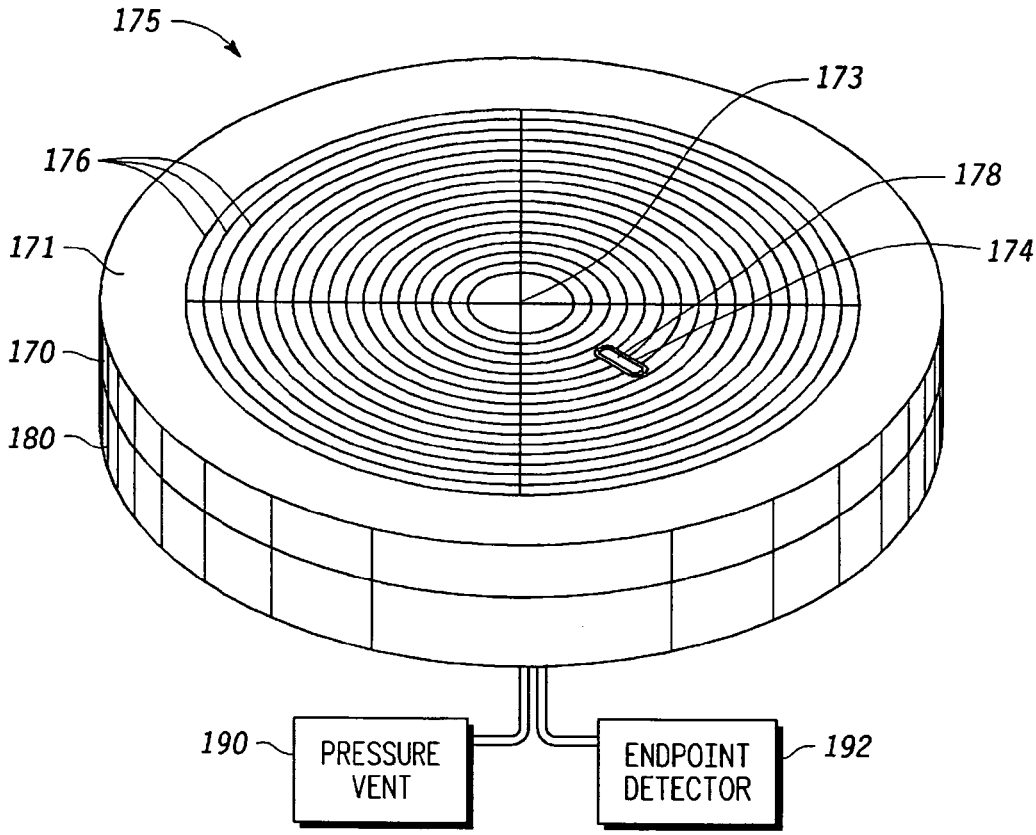
FIG. 8 illustrates an elevated view of a grooved platen assembly having a pressure vented platen endpoint window as part of an endpoint detection systems.

While selected embodiments of the present invention use air permeable properties of a platen endpoint window to vent or discharge air gap pressure buildup between the pad and platen endpoint windows, it is contemplated that other venting techniques may be used in addition to, or as alternatives to, such air permeable platen endpoint windows. For example, FIG. 8 illustrates an elevated view of a grooved platen assembly 175 which includes a grooved platen 170, a subplaten 180 that is part of the polisher equipment, a pressure vent system 190 and an endpoint detection system 192 which uses endpoint detection sensor equipment (not shown) in the aperture 174 to provide in-situ monitoring of CMP operations through an opening in the pad (not shown) that is affixed to the platen 170. An optical fiber bundle (not shown) connects the sensor equipment in the aperture 174 to the endpoint detector system 192, such as by running the bundle under the surface of the platen 170 inwardly and radially to the center of the platen 170 and out to the endpoint detector 192.

As depicted in FIG. 8, the platen 170 includes a pressure vented platen endpoint window 178 formed in an aperture 174 to vent the air gap between the platen endpoint window 178 and the pad endpoint window that is affixed as part of the polishing pad (not shown). In addition or in the alternative, air gap pressure may be vented through a predetermined pattern of grooves or channels 176 that are formed within a sealing region 171 in the platen endpoint window 178 and connected to the pressure vent system 190. As illustrated, the channels or grooves 176 are formed on the interior of the upward face of the platen 170, and are sealed from the processing environment by an ungrooved portion 171 at the periphery of the platen 170. To form the grooves 176 in the platen 170, the platen may be cast, molded or machined by cutting grooves in the platen with a lathe or other cutting machine. Because of the ungrooved portion 171, the grooves or channels 176 do not extend to the edge of the top surface of the platen 170, thereby preventing liquid vapor or other undesirable contaminants from the CMP process from intruding into the area between the pad and platen 170, including the air gap between the endpoint windows. However, a pathway 172 in the platen 170 may be used to release any air pockets trapped between the pad and platen 170, and/or to discharge or relieve any increase in air pressure in the inter-window air gap caused by the polishing operations. The pathway 172 may be formed as a straight or angled hole that is drilled through the platen 170 to an access hole in the lower control area of the polishing equipment (not shown). By providing a pathway 172 to an ambient or sub-ambient environment, any trapped air pockets and/or increase air pressure between the pad endpoint window and platen endpoint window are readily removed or vented. However, the pathway 172 may be used to vent air pressure or pockets without requiring the use of vacuum equipment, thereby reducing the cost and complexity of the overall CMP assembly.

As will be appreciated, the grooves 176 may be configured in any predetermined pattern (e.g., X-Y grid, radial pattern, starburst, concentric circles or any combination thereof) which is designed to cover or intersect with any minimum bubble spacing dimension. For example, to prevent the formation of half-inch (or larger) bubbles between the pad and platen, a pattern of concentric grooves 176 are formed using half inch radial spacing from the center of the platen 170 and out to the ungrooved portion 171. By including an X-shaped groove in the pattern that is positioned to cross the radial grooves and to intersect with the centrally located venting pathway 173, venting is provided from the radial grooves 176 to the pathway 173, which in turn is connected to the pressure vent system 190.

Depending on various design considerations—such as the diameter, thickness and/or flexibility of the polishing pad, the thickness of the platen endpoint window or the size of the air gap—the physical dimensions (e.g., size and spacing) of the grooves 176 are configured to vent the air gap and/or to prevent or eliminate the formation of bubbles or trapped air pockets between the upper surface of the platen 170 and any applied polishing pad or adhesive layer. In a first illustrative embodiment, an aluminum platen 170 is formed with grooves 176 that are spaced apart at half-inch intervals, that have a width of approximately 0.02 inches (e.g., 0.02±0.003 inches), that have a depth of approximately 0.02 inches (e.g., 0.02±0.003 inches) and that are sealed with a 1 inch ungrooved region 171 at the outer edge of the platen 170. In another illustrative embodiment, a ceramic platen 170 is formed with grooves 176 that are spaced apart at half-inch intervals, that have a width of approximately 0.03 to 0.04 inches, that have a depth of approximately 0.02 inches (e.g., 0.02±0.003 inches) and that are sealed with a 1 inch ungrooved region 171 at the outer edge of the platen 170.

Figure 9:
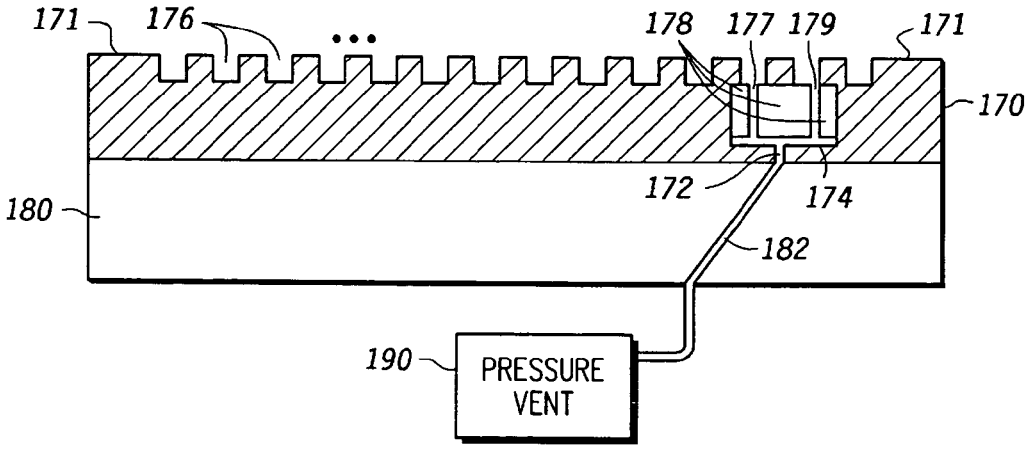
FIG. 9 illustrates a side view of the grooved platen assembly of FIG. 8.

As indicated above, the groove pattern 176 may be connected to the pressure vent system 190 through a centrally located venting pathway 173, thereby providing a vent path for relieving pressure buildup in the air gap between the pad and platen. Indeed, by using a grooved platen which vents through a centrally located venting pathway 173, a vented platen endpoint window may not be necessary. In addition or in the alternative, other venting pathways may be used to connect the grooves 176 and vented platen endpoint window 178 to the pressure vent system 190, such as depicted in FIG. 9, which illustrates a side view of the grooved platen assembly 175 of FIG. 8. As depicted, a vent pathway in the platen 170 includes one or more grooved openings 176 in the platen 170, one or more passageways 177, 179 in the platen endpoint window 178, a first vent pathway 172 in the platen 170, and second vent pathway 182 (e.g., angled hole) in the subplaten 180 that connects to the ambient air or pressure vent system 190. As will be appreciated, additional vent pathways may be used, and may be formed at any desired angle and/or width, though the configuration of the vent pathways 172 should be chosen to intersect with a hole 182 in the subplaten 180 that accesses ambient air or pressure vent system 190. For example, the vent pathways 172, 182 may be formed as a straight or angled hole with a diameter of approximately 0.12 inches. Alternatively, the vent pathway 172 may be formed as a straight or angled hole with a diameter of approximately 0.188 inches.

Whatever pattern of grooves or channels 176 is used on the surface of the platen 170, the pattern should be positioned to overly or intersect with one or more openings to the platen pathway(s) 172 and/or 173, thereby providing an air vent or path to ambient or sub-ambient environment that reduces or eliminates the formation of air pockets or bubbles. By removing or reducing air pockets between the pad and platen, localized pad wear and related pad deformations are minimized, non-uniform polishing characteristics are reduced, premature pad failure is prevented and manufacturing cycle time is reduced, thereby lowering costs and improving yield. In addition, by sealing the platen grooves 176 from the peripheral edges of the top surface of the platen 170, liquid vapor or other undesirable contaminants from the CMP process are prevented from entering the grooved area between the pad and platen 170. The venting of air pressure between the endpoint windows also eliminates pad endpoint window bulging which can distort endpoint detection and cause wafer slips, thereby reducing tool downtime, SPC metrics, the impact wafer scrap, damage to polisher and reduced cost of ownership.

As will be appreciated, a variety of different grooved and vented platen configurations may be used to obtain various benefits of the present invention. For example, the grooved platen may be formed with a single channel or groove in which is formed and/or affixed a rigid layer of porous material, and which is sealed from the processing environment by an ungrooved portion at the periphery of the platen so that any liquid vapor or other undesirable contaminants from the CMP process are cannot reach the area between the pad and platen. Alternatively, the porous material may also be formed within a plurality of grooves, such as shown in FIG. 9. The porous material allows for the escape of any air trapped during assembly or operation of the polishing pad and platen through one or more pathways in the platen. In another embodiment, the grooved platen may which include one or more pathways that connect an opening in at least a first groove area to a peripheral side opening in the platen to release any air pockets trapped between the pad and platen, and/or to discharge or relieve any increase in air pressure caused by the polishing operations. By filling the peripheral side opening pathways with an air permeable hydrophobic material, air pressure is released without letting liquid vapor or other undesirable contaminants from the CMP process to enter the area between the pad and platen. In addition or in the alternative, the peripheral side opening pathways may include a microcheck valve which is normally closed to prevent liquid vapor or other undesirable contaminants from the CMP processing environment from entering the grooved area, but is configured to open when internal pressure exceeds a predetermined pressure threshold, thereby venting air from the grooves.

In operation, a polishing pad (not shown) is adhesively affixed to the platen 170 to form a polishing pad assembly which is rotated or spun about its central axis by a polisher (such as a 200 Mirra polisher). Because of the grooves 176 and platen passageway 172, 173, air pockets between the pad and platen are vented so that no bubbles can form between the adhesive and the platen. A structure to be polished (e.g., a partially completed integrated circuit or wafer structure on which an interlayer dielectric or metal layer has been formed) is then placed in polishing contact with the spinning polishing pad assembly. For example, the structure is affixed to a polishing arm which spins and moves the structure back and forth while pressing the structure against the rotating polishing pad in the presence of a polishing slurry. This effectively achieves planarizing a deposited or upper layer on the structure being polished.

In one form, a rotatable platen apparatus is provided for use in performing chemical mechanical polishing. The platen may be disk shaped, and includes a peripheral side edge, a lower surface and an upper surface for adhesive attachment to a polishing pad in which is optionally formed a pad endpoint window. In addition, the platen has a vented platen endpoint window and one or more vent pathways formed to connect the vented platen endpoint window with an opening in the platen so that air between the vented platen endpoint window and the pad endpoint window can vent through the vented platen endpoint window and the vent pathway to an ambient environment without allowing contaminants from the polishing process to infiltrate between the platen and the polishing pad. In various embodiments, the vented platen endpoint window is constructed with a diffuser window in which one or more passageways are formed for alleviating pressure buildup between the vented platen endpoint window and the pad endpoint window. In addition or in the alternative, the passageways may be at least partially filled with an air permeable hydrophobic material. Alternatively, the vented platen endpoint window is constructed with an air permeable material or an air permeable hydrophobic material. In yet another embodiment, a groove pattern formed on the upper surface of the platen without extending to any peripheral edge of the upper surface of the platen is used to vent air pressure from between the vented platen endpoint window and the pad endpoint window. The groove pattern may be formed in addition to the vented platen endpoint window, or may be formed as part of the vented endpoint window. The groove pattern may be formed with any desired pattern, so long as the groove pattern intersects with the first upper surface opening. For example, the groove pattern may be a plurality of concentric circles in combination with an X-shaped groove which are positioned to intersect with the vent pathway.

In another form, a method is described for performing chemical mechanical polishing. Under the method, a polishing pad assembly is constructed by applying (e.g., adhesively affixing) a polishing pad to an upper surface of a platen. The polishing pad has a pad endpoint window and a vent pathway which are configured to relieve pressure between the pad endpoint window and the platen endpoint window to an external environment. In a selected embodiment, air between the pad endpoint window and the platen endpoint window may be vented through an air passage formed in the platen endpoint window and through the vent pathway and to an external environment without allowing contaminants from the chemical mechanical polishing to infiltrate between the platen and the polishing pad. In one configuration, pressure is relieved through one or more passageways formed in the platen endpoint window which provide air flow from between the platen endpoint window and the pad endpoint window and to the vent pathway. In another configuration, pressure is relieved through one or more passageways formed in the platen endpoint window using an air permeable material. In yet another configuration, pressure is relieved through the platen endpoint window which is formed entirely from an air permeable material. In addition or in the alternative, air between the pad endpoint window and the platen endpoint window may be vented through a groove pattern formed in the upper surface of a platen which is connected through the vent pathway to the external environment, where the groove pattern does not extend to any peripheral edge of the upper surface of the platen. With the grooved pattern configuration, air between the platen endpoint window and the pad endpoint window is able to vent through the vent pathway without allowing contaminants from the chemical mechanical polishing to infiltrate between the platen and the polishing pad. Once assembled, the polishing pad assembly is used to performing chemical mechanical polishing on a polish structure by placing the polishing pad assembly in polishing contact with the polish structure.

In yet another form, a method is described for assembling a polishing pad assembly for use in performing a chemical mechanical polish process. First, a polishing pad is provided which includes a pad endpoint window. Next, the polishing pad is adhesively affixed to a first surface of a platen to construct a polishing pad assembly, where the platen includes a vented platen endpoint window and a passageway forming an air pathway between the vented platen endpoint window and an external environment. For example, by constructing the vented platen endpoint window as a diffuser window which is permeable to air, the air pathway includes the air permeable passageways in the diffuser window. With this construction, air from between the pad endpoint window and the platen endpoint window is vented through the vented platen endpoint window and the passageway formed in the platen to an external environment. In addition or in the alternative, air from between the pad endpoint window and the platen endpoint window may be vented through the one or more interconnected channels formed in the first surface of the platen which are enclosed by a peripheral sealing region on the first surface of the platen and which are connected to the passageway.

Although the described exemplary embodiments disclosed herein are directed to various examples of equipment used for performing chemical mechanical polishing, the present invention is not necessarily limited to the example embodiments. Thus, the particular embodiments disclosed above are illustrative only and should not be taken as limitations upon the present invention, as the invention may be modified and practiced in different but equivalent manners apparent to those skilled in the art having the benefit of the teachings herein. For example, alternative configurations and dimensions for the venting pathway and groove patterns may be used. Accordingly, the foregoing description is not intended to limit the invention to the particular form set forth, but on the contrary, is intended to cover such alternatives, modifications and equivalents as may be included within the spirit and scope of the invention as defined by the appended claims so that those skilled in the art should understand that they can make various changes, substitutions and alterations without departing from the spirit and scope of the invention in its broadest form.

Benefits, other advantages, and solutions to problems have been described above with regard to specific embodiments. However, the benefits, advantages, solutions to problems, and any element(s) that may cause any benefit, advantage, or solution to occur or become more pronounced are not to be construed as a critical, required, or essential feature or element of any or all the claims. As used herein, the terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus.

What is claimed is:

1. A method for performing chemical mechanical polishing, comprising;

assembling a polishing pad assembly by applying a polishing pad to an upper surface of a platen, where the platen comprises a vented platen endpoint window and at least one vent pathway formed through the platen for relieving pressure between the polishing pad and the vented platen endpoint window to an external environment; and performing chemical mechanical polishing on a polish structure by placing the polishing pad assembly in polishing contact with the polish structure.

2. The method of claim 1, where the vented platen endpoint window comprises one or more passageways for relieving air pressure between the vented platen endpoint window and the polishing pad.

3. The method of claim 1, where the vented platen endpoint window comprises one or more passageways which are at least partly formed with an air permeable material for relieving air pressure between the vented platen endpoint window and the polishing pad.

4. The method of claim 1, where the vented platen endpoint window is formed with an air permeable material for relieving air pressure between the vented platen endpoint window and the polishing pad.

5. The method of claim 1, where vented platen endpoint window comprises one or more passageways to provide air flow from between the vented platen endpoint window and the polishing pad and to the vent pathway.

6. The method of claim 1, where the platen comprises a groove pattern formed in the upper surface of a platen which does not extend to any peripheral edge of the upper surface of the platen and which is connected through the vent pathway to the external environment, such that air between the vented platen endpoint window and the polishing pad is able to vent through the vent pathway without allowing contaminants from the chemical mechanical polishing to infiltrate between the platen and the polishing pad.

7. The method of claim 1, where assembling a polishing pad assembly comprises:

adhesively affixing the polishing pad to the upper surface of the platen; and venting any air from between the polishing pad and the vented platen endpoint window through an air passage formed in the vented platen endpoint window and through the vent pathway and to an external environment without allowing contaminants from the chemical mechanical polishing to infiltrate between the platen and the polishing pad.

8. The method of claim 7, further comprising venting any air from between the polishing pad and the vented platen endpoint window through a groove pattern formed in the upper surface of a platen and to an external environment.

9. A method for assembling a polishing pad assembly for use in performing a chemical mechanical polish process, comprising;

providing a polishing pad in which is formed a pad endpoint window;

adhesively affixing the polishing pad to a first surface of a platen, where the platen comprises:

a vented platen endpoint window, and at least one passageway forming an air pathway between the vented platen endpoint window and an external environment; and venting air from between the pad endpoint window and the platen endpoint window through the vented platen endpoint window and the passageway formed in the platen to an external environment.

10. The method of claim 9, further comprising venting air from between the pad endpoint window and the platen endpoint window through one or more interconnected channels formed in the first surface of the platen which are enclosed by a peripheral sealing region on the first surface of the platen.

11. The method of claim 9, where the vented platen endpoint window comprises a diffuser window which is permeable to air.

12. An apparatus for use in performing chemical mechanical polishing, comprising:

a platen comprising a vented platen endpoint window and an upper surface for adhesive attachment of a polishing pad; and at least one vent pathway formed in the platen to connect the vented platen endpoint window with an opening in the platen, such that air between the vented platen endpoint window and the polishing pad is able to vent through the vented platen endpoint window and the vent pathway without allowing contaminants from the polishing process to infiltrate between the platen and the polishing pad.

13. The apparatus of claim 12, where the vent pathway is connected to an ambient environment.

14. The apparatus of claim 12, where the vented platen endpoint window comprises a diffuser window in which is formed one or more passageways for alleviating pressure buildup between the vented platen endpoint window and the polishing pad.

15. The apparatus of claim 12, where the vented platen endpoint window comprises a diffuser window in which is formed at least one passageway that is at least partially filled with an air permeable hydrophobic material.

16. The apparatus of claim 12, where the vented platen endpoint window comprises a diffuser window formed from an air permeable material.

17. The apparatus of claim 12, where the vented platen endpoint window comprises a diffuser window formed from an air permeable hydrophobic material.

18. The apparatus of claim 12, further comprising a predetermined groove pattern formed in the upper surface of the platen without extending to any peripheral edge of the upper surface of the platen so that air between the vented platen endpoint window and the polishing pad is able to vent through the predetermined groove pattern.

19. The apparatus of claim 18, where the predetermined groove pattern comprises a pattern of concentric circles in combination with an X-shaped groove which are positioned to intersect with the vent pathway.

20. The apparatus of claim 12, where the vented platen endpoint window comprises a diffuser window which is vented through a predetermined groove pattern formed in the upper surface of the platen and connected to the vent pathway so that air pressure between the diffuser window and the polishing pad is able to vent through the predetermined groove pattern.

* * * * *